US007070266B2

(12) United States Patent
Ogawa et al.

(10) Patent No.: US 7,070,266 B2
(45) Date of Patent: Jul. 4, 2006

(54) INK JET RECORDING HEAD CARTRIDGE

(75) Inventors: Masashi Ogawa, Kanagawa (JP); Yasuo Kotaki, Kanagawa (JP); Wataru Takahashi, Kanagawa (JP); Hiromasa Anma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 10/799,019

(22) Filed: Mar. 12, 2004

(65) Prior Publication Data

US 2004/0189760 A1 Sep. 30, 2004

(30) Foreign Application Priority Data

Mar. 27, 2003 (JP) ..... 2003-087703

(51) Int. Cl.
*B41J 2/175* (2006.01)

(52) U.S. Cl. ..... 347/87

(58) Field of Classification Search ..... 347/86, 347/87, 92

See application file for complete search history.

(56) References Cited

U.S. PATENT DOCUMENTS 4,368,478 A * 1/1983 Koto ..... 347/86
4,998,120 A * 3/1991 Koto et al. ..... 347/70
5,812,165 A 9/1998 Boyd et al.
6,783,220 B1 * 8/2004 Ujita et al. ..... 347/87

* cited by examiner

*Primary Examiner*—Anh T.N. Vo
(74) *Attorney, Agent, or Firm*—Morgan & Finnegan, L.L.P.

(57) ABSTRACT

An ink jet recording head cartridge has a liquid container for retaining a liquid, a discharge circuit section which comprises a supply port for receiving the liquid in the liquid container, a nozzle in communication with the supply port, and a discharge energy generating element, provided in the nozzle, for discharging the liquid; and a flow path for leading the liquid from the liquid container to the discharge circuit section, wherein the flow path comprises a vertical portion extending from a portion connecting to the ink container, and a horizontal portion connecting to a lower end of the vertical portion and connecting to the supply port of the discharge circuit section, a throttle portion whose width becomes narrower in a supply direction of the liquid is formed in a portion, which connects to the vertical portion, of the horizontal portion of the flow path, and a groove shaped flow path whose width is narrower than the total width of the flow path is contiguously formed on an inner wall of the flow path from a portion connecting to the liquid container to a portion connecting to the discharge circuit section.

6 Claims, 4 Drawing Sheets

INK JET RECORDING HEAD CARTRIDGE

BACKGROUND OF THE INVENTION

1. Field of the Invention

The present invention relates to an ink jet recording head, and in particular, to an ink jet recording head cartridge which integrally comprises a container for retaining a liquid (ink) used for recording.

2. Description of the Related Art

An ink jet recording head generally has a plurality of discharge energy generating elements which generate energy for discharging an ink, and a plurality of nozzles leading to a plurality of discharge ports which discharge the ink through the discharge energy generating elements. It is known that heater elements are used as the discharge energy generating elements, and in this case, a liquid is bubbled by the heater elements, and a pressure produced thereby is utilized to discharge the ink. The ink jet recording head using such heater elements are easy in size reduction, and a part including the heater elements and nozzles may be configured as a small-sized heating circuit section. Such an ink jet recording head may further be configured as an ink jet recording head cartridge which integrally comprises a container for retaining the ink, and a member forming a flow path for providing the ink from the container to the heating circuit section.

In the flow path of such an ink jet recording head cartridge, bubbles tend to accumulate inside due to air entering inside the flow path, especially entering under the influence of environmental changes, air remaining in the ink, air separated from the ink as the ink is heated by the heater elements, air mixed in the flow path in a head manufacturing process, and the like. When many bubbles are produced inside the flow path, they interrupt the ink supply to a heater element section, so that sufficient supply of ink may not be possible, and especially, if the bubbles grow into large fixed bubbles in an ink supply passage, they can cause a problem that the ink supply passage is substantially completely blocked by the bubbles temporarily. Further, if the bubbles are scattered on the heater elements, they prevent predetermined bubbling, and the pressure to discharge the ink is absorbed by shrinkage of the bubbles due to so-called damper effects, which might prevent a predetermined ink discharge operation. In this way, the bubbles accumulated in the ink flow path of the cartridge may cause defective recording.

Various methods have heretofore been used to reduce adverse effects of the bubbles accumulated in the flow path as described above. As such methods, a method of reducing a dissolved gas in the ink by deaeration, a method of providing a vapor-liquid separation film inside the ink supply passage, and the like have been known. Moreover, as a method of physically removing the bubbles, a method of removing the bubbles by pumping them together with the ink from the discharge port has been known, and an attempt is also made to make components of the ink easy to debubble. In addition, a specification of U.S. Pat. No. 5,812,165 discloses a method in which the bubbles are retained under a filter, which does not let relatively enlarged bubbles, by use of buoyancy of the bubbles at a vertical portion of the ink supply passage, thereby reducing the bubbles remaining on a further downstream side.

In the above-mentioned method of removing the dissolved gas by deaeration, its manufacturing process is complicated. Moreover, as it is necessary to maintain a state with no air infiltrating into an ink supply system also in actual use, a cartridge configuration is complicated. Further, even with the configuration that reduces the air infiltration, it is difficult to completely prevent air from infiltrating from a cartridge material surface and the discharge port over time, and it is also difficult to maintain a substantially deaerated state over time.

In the method of providing the vapor-liquid separation film, it is necessary to provide a space to dispose this film inside the supply system, and especially necessary to dispose it in the vicinity of the nozzles in order to reduce effects of the bubbles entering from the ink discharge port, so that the cartridge configuration is complicated.

When the method of removing the bubbles by suction, the flow path preferably has a shape or the like that makes it easy to remove the bubbles by suction. However, even this can not avoid a certain amount of ink consumption in addition to bubble removal when suction is used. Moreover, a suction mechanism, an absorbing member to retain the sucked ink in a printer main unit, and the like are required, resulting in an increase in costs of the printer main unit. Further, the ink might also be sucked in a portion where the bubbles are not produced, depending on a shape of a suction system, which might increase the amount of ink to be disposed of, and place an additional burden on users.

In the method of retaining the bubbles under the filter provided in the vertical portion of the ink supply passage as disclosed in the specification of U.S. Pat. No. 5,812,165, if the bubbles grow above a certain level, the ink supply may conceivably be blocked. Especially, in a configuration described in the specification of U.S. Pat. No. 5,812,165, a step portion is provided under the filter in the vertical portion of the ink supply passage, and if the bubbles grow beyond a space surrounded by the step portion and the filter, the ink supply may conceivably be more easily blocked. In addition, if a gas grows up to a horizontal portion of the ink supply passage, the ink supply may conceivably be blocked in the configuration described in the specification of U.S. Pat. No. 5,812,165.

A significant speed increase has been recently achieved in the ink jet recording head, and therefore, the amount of ink required per unit time has been increasing. For this reason, adverse effects on a recording operation due to the bubbles preventing the ink supply as described above have become a greater problem, and even if a greater amount of ink is supplied per unit time, it is even more necessary to prevent a supply amount shortage.

SUMMARY OF THE INVENTION

The present invention has been attained to solve the problems possessed by the prior art as mention above, and an object of the present invention is to provide an ink jet recording head cartridge capable of stably supplying a great flow volume of ink, and stably and satisfactorily performing a recording operation.

To accomplish the above object, an ink jet recording head cartridge of the present invention has:

a liquid container for retaining a liquid;

a discharge circuit section which comprises a supply port for receiving the liquid in the liquid container, a nozzle in communication with the supply port, and a discharge energy generating element, provided in the nozzle, for discharging the liquid; and a flow path for leading the liquid from the liquid container to the discharge circuit section;

wherein the flow path comprises a vertical portion extending from a portion connecting to the ink container, and a horizontal portion connecting to a lower end of the vertical portion and connecting to the supply port of the discharge circuit section;

a throttle portion whose width becomes narrower in a supply direction of the liquid is formed in a portion, which connects to the vertical portion, of the horizontal portion of the flow path; and a groove shaped flow path whose width is narrower than the total width of the flow path is contiguously formed on an inner wall of the flow path from a portion connecting to the liquid container to a portion connecting to the discharge circuit section.

As described above, according to the present invention, it is possible to provide an ink jet recording head cartridge capable of stably supplying a great flow volume of ink and stably performing a recording operation by forming the groove shaped flow path in the flow path and further providing the throttle portion in the horizontal portion of the flow path so as to prevent an ink supply from being blocked by bubbles produced in the ink, and so as to prevent adverse effects from being exerted on ink discharge. It is also possible to make the discharge circuit section more compact and lower costs.

BRIEF DESCRIPTION OF THE DRAWINGS

FIG. 1A is a vertical sectional view, and FIG. 1B is a sectional view cut along the line 1B—1B of FIG. 1A;

FIG. 2A is a vertical sectional view, and FIG. 2B is a sectional view cut along the line 2B—2B of FIG. 2A;

FIG. 3A is a vertical sectional view, and FIG. 3B is a sectional view cut along the line 3B—3B of FIG. 3A;

FIG. 4A is a vertical sectional view, FIG. 4B is a sectional view cut along the line 4B—4B of FIG. 4A, and FIG. 4C is a sectional view cut along the line 4B—4B of FIG. 4A;

FIG. 5A is a vertical sectional view, and FIG. 5B is a sectional view cut along the line 5B—5B of FIG. 5A;

FIG. 6A is a vertical sectional view, and FIG. 6B is a sectional view cut along the line 6B—6B of FIG. 6A;

FIG. 7A is a vertical sectional view, and FIG. 7B is a sectional view cut along the line 7B—7B of FIG. 7A.

DETAILED DESCRIPTION OF THE PREFERRED EMBODIMENTS

Embodiments of the present invention will next be described in reference to the drawings.

Figure 1A:
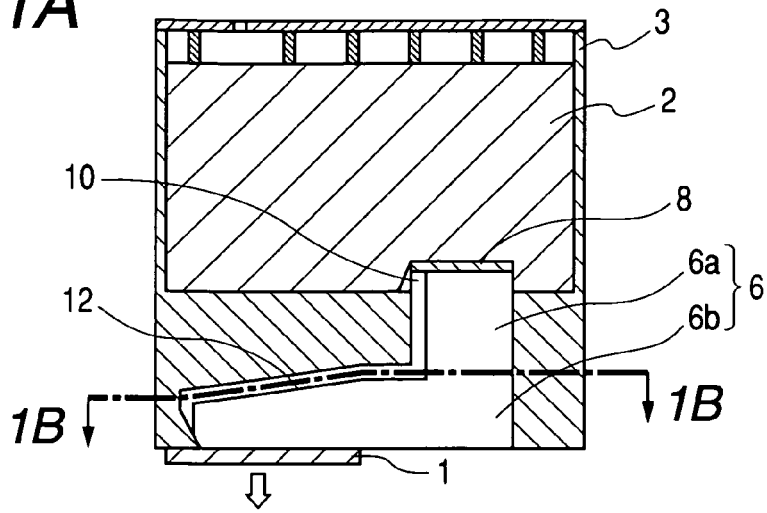
FIGS. 1A and 1B are pattern diagrams of an ink jet recording head cartridge in one embodiment of the present invention.
Figure 1B:
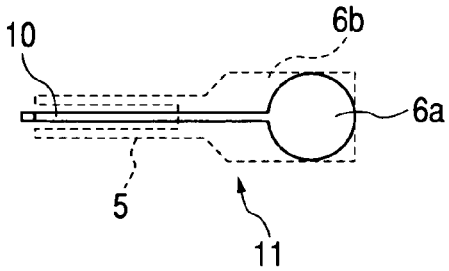

FIGS. 1A and 1B are pattern diagrams of an ink jet recording head cartridge in one embodiment of the present invention, and FIG. 1A is a sectional view cut in a vertical direction, and FIG. 1B is a sectional view cut along the line 1B—1B of FIG. 1A.

This ink jet recording head cartridge has a discharge circuit section 1 comprising discharge energy heat generating elements and nozzles for discharging an ink (liquid), and the ink is discharged downward from the discharge circuit section 1 as indicated by an arrow in FIG. 1A, and the discharged ink is stuck onto a paper surface to accomplish recording. A heater element is used as the discharge energy generating element. A supply port 5 leading to each nozzle is formed on an upper surface, which is opposite to an ink discharge direction, of the discharge circuit section 1, and on this surface where the supply port 5 is formed, a member which forms an ink container (liquid container) 3 and a flow path 6 is integrally mounted.

An ink absorbing member 2 which retains the ink is provided in the ink container 3. The flow path 6 is in an almost L-shape having a vertical portion 6*a* formed by a column-shaped path extending downward from a portion of the ink container 3, and a horizontal portion 6*b* which is connected to a lower end of the vertical portion 6*a* and extends to the supply port 5 of the discharge circuit section 1. On an inner surface of the flow path 6, a groove shaped flow path 10 is formed which extends along a sidewall of the vertical portion 6*a* and further extends from there along an upper wall of the horizontal portion 6*b*. The groove shaped flow path 10 has a width smaller than the width of the entire flow path 6, so that when a relatively large bubble is formed in the flow path 6, a surface of this bubble can not enter into the groove shaped flow path 10, thereby keeping the ink flowing through the groove shaped flow path 10.

An upper end of the vertical portion 6*a* of the flow path 6 protrudes into the ink container 3, and is formed by a column-shaped member that enters into the ink absorbing member 2. Such a configuration generates a force to draw the ink retained in the ink absorbing member 2 to the vicinity of the upper end of the vertical portion 6*a*. A filter 8 is provided on an opening of the upper end of the vertical portion 6*a* between the opening and the ink absorbing member 2. The filter 8 serves to prevent impurities from entering into the flow path 6, and to retain the ink drawn to the vicinity of the column-shaped member forming the upper end of the vertical portion 6*a* of the flow path 6 by a meniscus force generated in the filter 8.

The horizontal portion 6*b* extends along the discharge circuit section 1 over almost the total width of the discharge circuit section 1, and the supply port 5 of the discharge circuit section 1 extends in a part where the horizontal portion 6*b* is located above, over almost the total width of the discharge circuit section 1. With such a configuration in which an entire area of the supply port 5, which extends over the total width of the discharge circuit section 1 and is therefore relatively large, opens toward the flow path 6, the bubble produced in the ink on the side of the discharge circuit section 1 can be easily led to the side of the flow path 6 by its buoyancy. This makes it possible to prevent the bubble from remaining on the side of the discharge circuit section 1, especially in the vicinity of its heater element, and thus effectively prevent adverse effects from being exerted on ink discharge.

Furthermore, in the horizontal portion 6*b*, a throttle portion 11 whose width becomes narrower toward the supply port 5 is provided from a portion connecting to the vertical portion 6*a* to a portion reaching the supply port 5. In an illustrated example, the throttle portion 11 is configured with inclined walls so that the width gradually becomes narrower from the vertical portion 6*b* of the flow path 6 toward the supply port 5 of the discharge circuit section 1, that is, in a supply direction of the ink. In a ceiling portion of the horizontal portion 6*b*, an inclined portion 12 which gradually becomes higher in a direction departing from the side of the supply port 5 is provided closer to the side of the supply port 5 than the throttle portion.

In this ink jet recording head cartridge, a buoyancy which tends to rise upward oppositely to the ink discharge direction acts on the bubble (not shown) produced in the flow path 6. Therefore, an bubble 9 rises in the flow path 6, and tends to be retained at a highest position in the vertical portion 6*a* of the flow path 6, that is, immediately under the filter 8 and at the ceiling portion which is the highest position in the horizontal portion 6*b* of the flow path 6. According to the configuration of the present embodiment, even when the bubble is retained in these places, sufficient ink can run as the groove shaped flow path 10 is provided in these places, and thus sufficient ink can be supplied to the discharge circuit section 1.

Furthermore, according to the configuration of the present embodiment, part of the bubble in the flow path 6 flows into the discharge circuit section 1 so as to effectively prevent an adverse impact on ink discharge. In order to explain such effects brought by the configuration of the present embodiment, the impact of the bubble retained at the horizontal portion of the flow path in the ink jet recording head cartridge having a configuration to be contrasted with the configuration of the present embodiment will be described referring to FIGS. 2A, 2B, 3A and 3B.

FIGS. 2A, 2B, 3A and 3B are pattern diagrams showing a part of a flow path 56 comprised of a vertical portion 56*a* and a horizontal portion 56*b*, in the ink jet recording head cartridge having the configuration to be contrasted with that of the present embodiment, in which the ink container and the like are not illustrated. In this flow path 56, the groove shaped flow path 10, the throttle portion 11 and the inclined portion 12 in the ink jet recording head cartridge of the present embodiment are not provided.

Figure 2A:
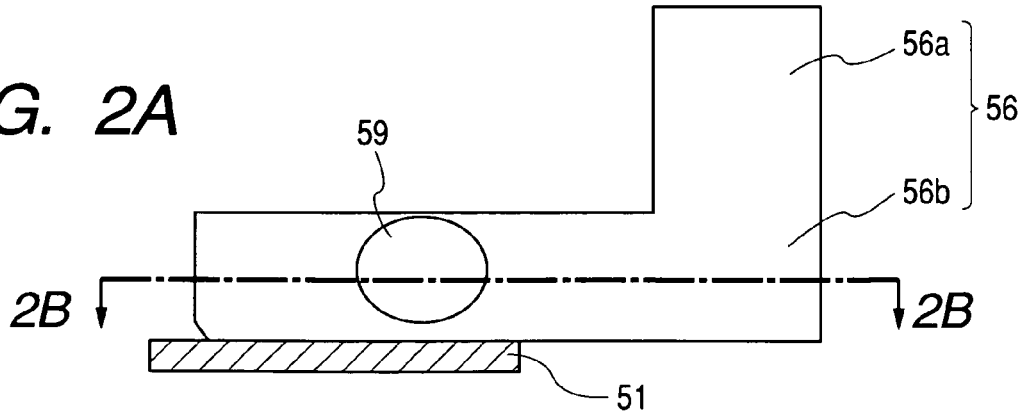
FIGS. 2A and 2B are pattern diagrams showing a part of a flow path in which an bubble is produced, in the ink jet recording head cartridge having a configuration to be contrasted with FIGS. 1A and 1B.
Figure 2B:
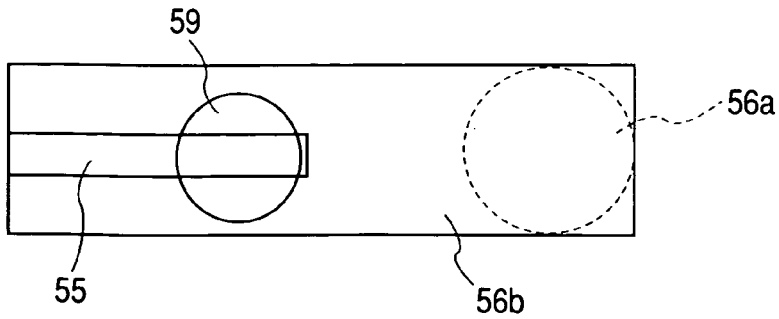

As shown in FIGS. 2A and 2B, when the ink is discharged from a discharge circuit section 51, a force trying to move toward the supply port 5 acts on an bubble 59 retained at a ceiling portion of the horizontal portion 56*b* of the flow path 56, in the horizontal portion 56*b*, due to flow of the ink supplied from the side of the vertical portion 56*a* to the side of a supply port 55 of the discharge circuit section 51. As a result, the bubble 59 tends to be positioned on the supply port 55, and part of the bubble 59 becomes easy to flow from the supply port 55 to the side of the discharge circuit section 51. When the part of the bubble 59 thus flows to the discharge circuit section 51, this destabilizes the ink discharge, and an adverse effect may further be exerted on the ink discharge; for example, the ink can not be discharged.

Figure 3A:
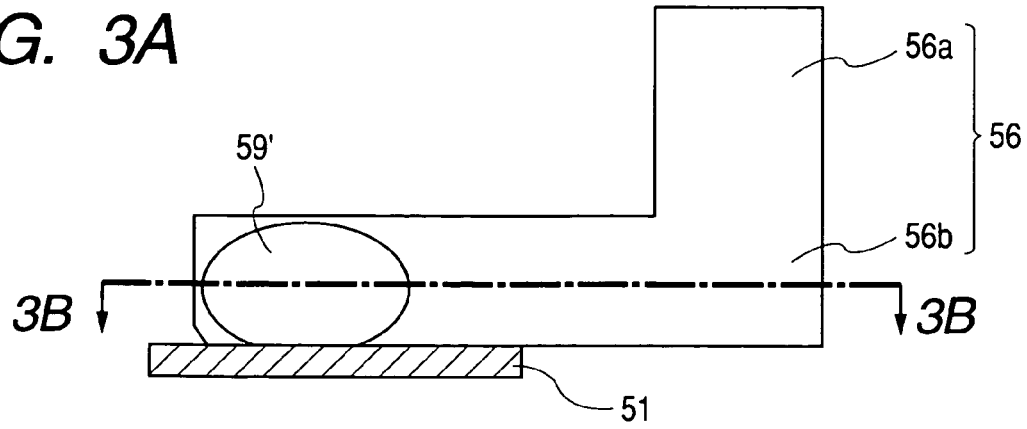
FIGS. 3A and 3B are pattern diagrams showing the part of the flow path in which the bubble has grown larger, in the ink jet recording head cartridge of FIGS. 2A and 2B.
Figure 3B:
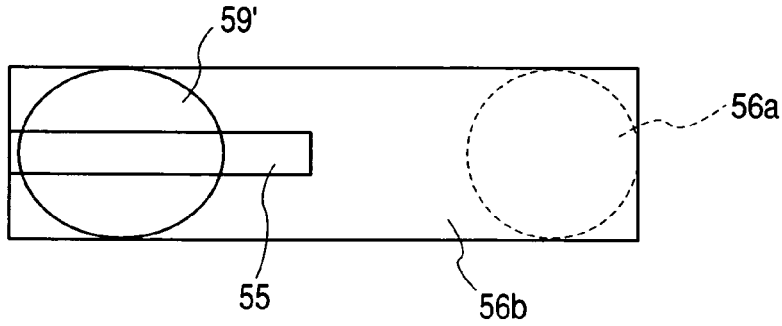

Furthermore, the retained bubble 59 tends to be combined with bubbles produced with time in the flow path 56 to grow further. If a large bubble 59' is thus formed on the supply port 55 as shown in FIGS. 3A and 3B, part of the bubble 59' is more easily led to the discharge circuit section 51 through the supply port 5.

Figure 4C:
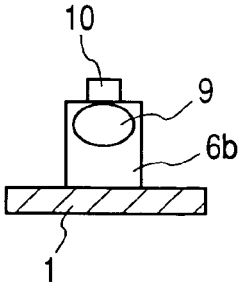
FIGS. 4A, 4B and 4C are pattern diagrams showing the part of the flow path in which the bubble is produced, in the ink jet recording head cartridge of FIGS. 1A and 1B.
Figure 4A:
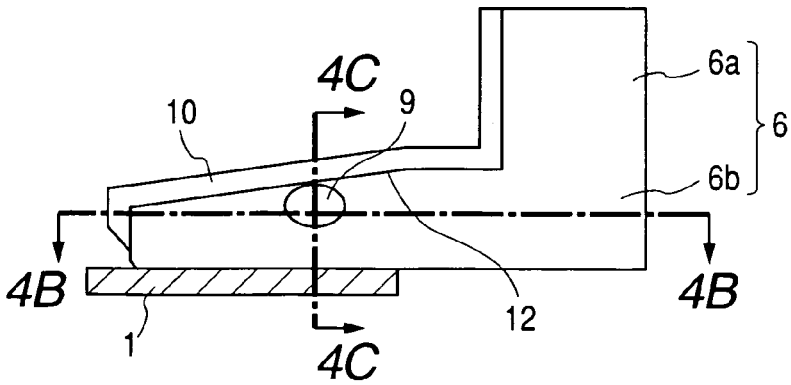
Figure 4B:
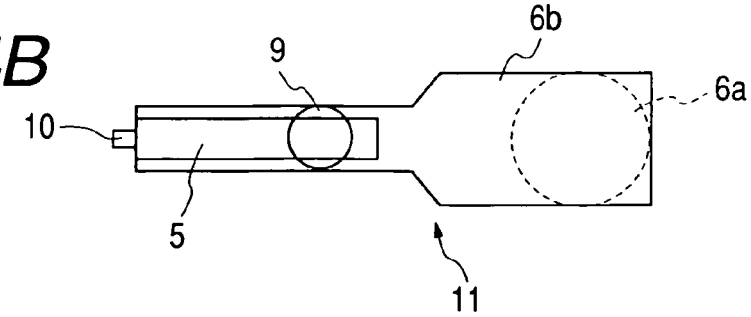

On the other hand, according to the configuration of the present embodiment, since the inclined portion 12 is provided for the bubble 9 located at the ceiling portion of the horizontal portion 6*b* of the flow path 6 as shown in FIGS. 4A to 4C, a force is applied by buoyancy to move the bubble closer to the side of the vertical portion 6*a* than the throttle portion 11. Further, as the ink flows through the groove shaped flow path 10, a force is applied to the bubble 9 to rotate it in a counterclockwise direction in FIG. 4A, and the bubble 9 thus rotates whereby the force is applied to the bubble 9 to move it to the side of the vertical portion 6*a* as a result. Therefore, even if the bubble 9 has a small diameter and is difficult to move only by buoyancy, it can effectively be led to the side of the vertical portion 6*a*. In this way, in the configuration of the present embodiment, the bubble 9 is led to the vicinity of the supply port 5, and part of the bubble 9 is inhibited from flowing to the discharge circuit section 1 via the supply port 5, thereby enabling improved reliability in the ink discharge.

Figure 5A:
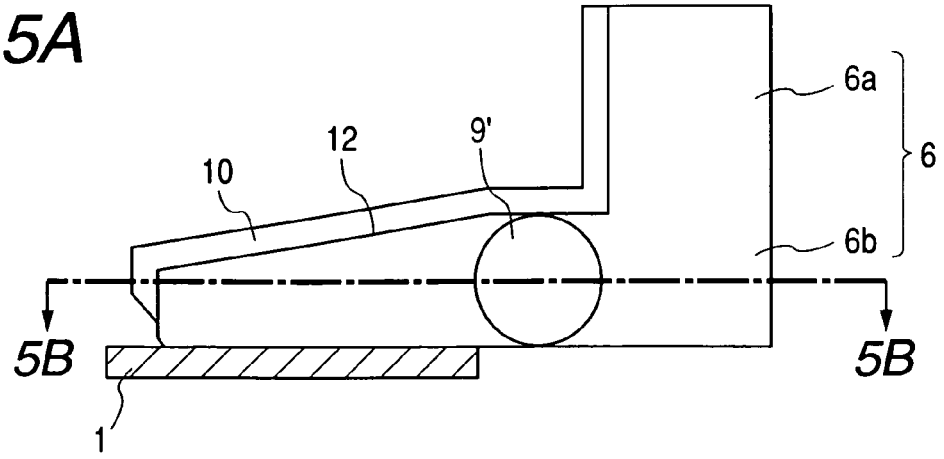
FIGS. 5A and 5B are pattern diagrams showing the part of the flow path in which the bubble has grown larger, in the ink jet recording head cartridge of FIGS. 1A and 1B.
Figure 5B:
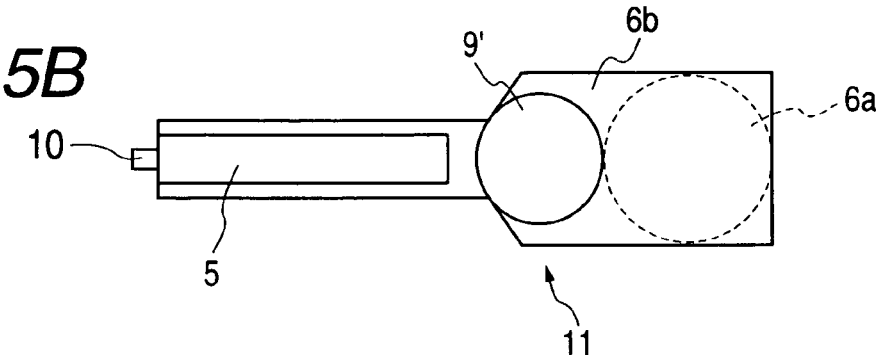

Furthermore, as the bubble 9 is moved to the side of the vertical portion 6*a* by the throttle portion 11 as described above and grows with time at that position to form a larger bubble 9' as shown in FIGS. 5A and 5B, the bubble 9' gets stuck with the throttle portion 11 and is retained on the side of the vertical portion 6*a* by the throttle portion 11. The retained bubble 9' can be retained until, for example, the gas 9' grows or is deformed along a sidewall of the throttle portion 11 by the flow of the ink to lower internal energy of the gas 9'. In other words, the bubble 9' which has grown relatively large can be retained away from the supply port 5, and part of the bubble 9' can therefore be prevented from flowing to the discharge circuit section 1 via the supply port 5, thereby enabling improved reliability in the ink discharge.

It should be noted that in the present invention, an amount of bubbles that can be retained closer to the side of the vertical portion 6*a* than the throttle portion 11 can be controlled by adjusting the position of the throttle portion 11, the width and height of the horizontal portion 6*b* in a part closer to the side of the vertical portion 6*a* than the throttle portion 11, the shape of the throttle portion 11, and the like. The amount of bubbles 29 that can be retained is preferably controlled as necessary in accordance with a specific type of usage of the ink jet recording head cartridge. For example, in the case of a cartridge to be mounted on an ink jet recording apparatus having a function to restore suction for removing the bubbles, the amount of bubbles that can be retained is set in accordance with the amount of bubbles expected to be produced in the flow path 6 during the intervals of period when the suction is expected to be restored. In the case of a cartridge to be mounted on an ink jet recording apparatus without the suction restoring function, the amount of bubbles that can be retained is set in accordance with the amount of bubbles expected to be produced in the flow path 6 during the expected period in which the ink retained in the cartridge is consumed and replaced, or during the period in which the cartridge comes to an end.

The amount of bubbles that can be retained closer to the side of the vertical portion 6*a* than the throttle portion 11 is thus set as needed, so that the proper configuration can be accomplished; for example, the size of a space that can retain the bubbles is minimized while effects of reducing the adverse impact of the bubbles are maintained over an expected period of service. In this case, even if more than expected bubbles are produced in the flow path 6 due to a physicality change or the like of the ink caused by an environmental change, the flow path 6 can be prevented from being blocked by the bubble because the introduction path 10 is provided, so that sufficient ink supply to the discharge circuit section 1 can be maintained.

Furthermore, the groove shaped flow path 10 is configured to extend along the ceiling portion of the horizontal portion 6*b* of the flow path 6 as shown in the embodiment described above, but the groove shaped flow path may be provided along a bottom surface.

Figure 6A:
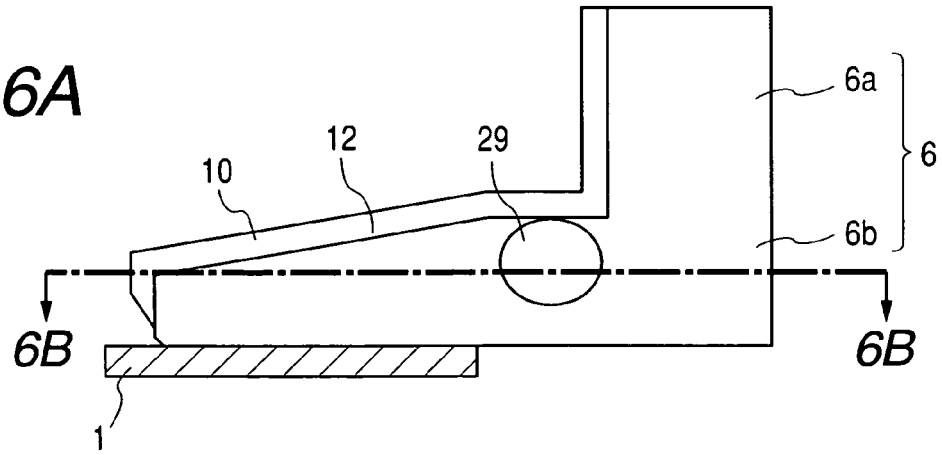
FIGS. 6A and 6B are pattern diagrams showing the part of the flow path in the ink jet recording head cartridge in another embodiment of the present invention.
Figure 6B:
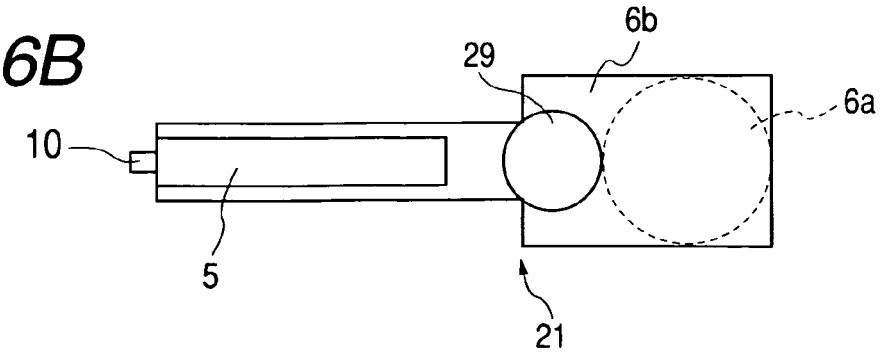

Still further, the throttle portion 11 has a width that gradually becomes narrower from the horizontal portion 6*b* of the flow path 6 toward the supply port 5, that is, in the supply direction of the ink in the embodiment described above, but instead of this throttle portion 11, a throttle portion 21 configured with walls vertical to the supply direction of the ink may be provided as shown in FIG. 6 in another embodiment. In the former configuration, the relatively large bubble 9' can be retained, while in the latter configuration, the bubble 29 can be firmly retained by more effectively preventing the bubble 29 from escaping to the side of the supply port 5.

Figure 7A:
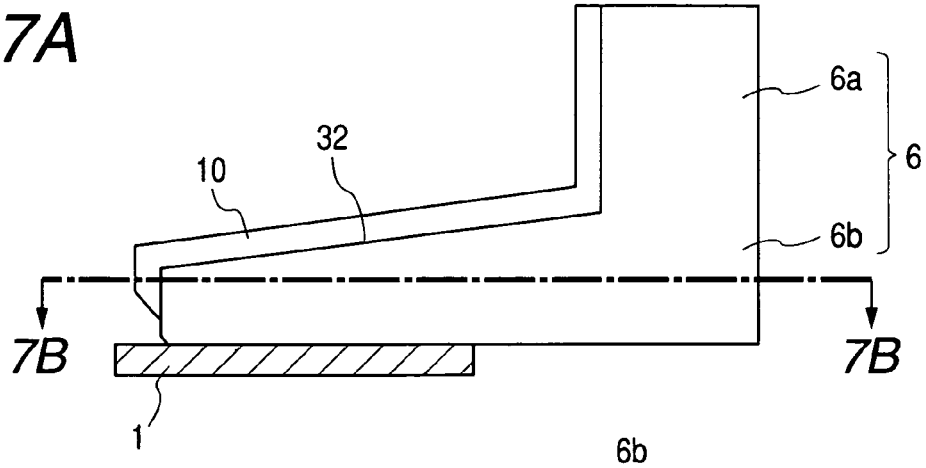
FIGS. 7A and 7B are pattern diagrams showing the part of the flow path in the ink jet recording head cartridge in still another embodiment of the present invention.
Figure 7B:
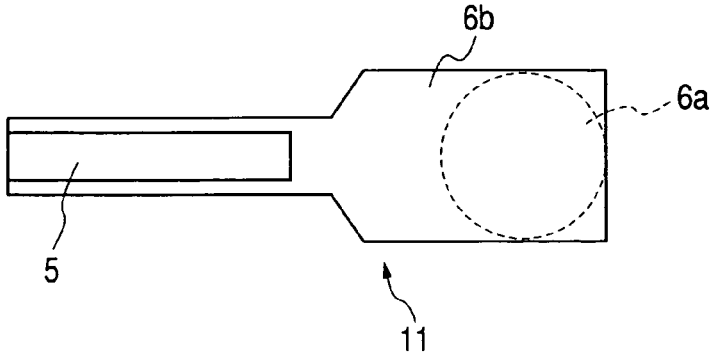

Further yet, in place of the inclined portion 12 extending to the throttle portion 11 in the embodiment described above, an inclined portion 32 configured to further extend to the vertical portion 6*a* may be provided as shown in FIGS. 7A and 7B in still another embodiment. Although the former configuration is sufficient to lead the bubble closer to the side of the vertical portion 6*a* than the throttle portion 11, the latter configuration can more effectively lead the bubble closer to the side of the vertical portion 6*a*.

Further yet, an example has been shown for easy understanding in the embodiment described above in which the ink is supplied from one ink container 3 via one flow path 6 through one supply port 5 provided in the discharge circuit section 1. However, in general, it is possible to have such a configuration that a plurality of supply ports 45 is provided in a discharge circuit board 41 and the ink is supplied from a plurality of ink containers as shown in FIG. 8C. That it, such a configuration is possible that the ink is supplied from three ink containers respectively retaining the ink of three colors, for example, yellow, magenta and cyan, and the ink of each color is selectively discharged from the discharge circuit board 41 so as to achieve color recording. Further, the configuration of the present invention as described above is applied to a flow path 46 for the ink of each color, thereby making it possible to configure a color ink jet recording head cartridge capable of reducing the adverse effects of the bubbles, stably supplying the ink, and stably and satisfactorily performing a recording operation.

In this case, it is advantageous to have a configuration in which the supply ports 45 of the discharge circuit section 41 extend over almost the total width of the discharge circuit section 41 as described above, and horizontal portions 46*b* of the flow path 46 extend above the supply ports 45 along their longitudinal direction. In this regard, it is effective to arrange the supply ports 45 in a direction perpendicular to the longitudinal direction. To enable the bubble to be retained at a part closer to the side of vertical portions 46*a* than the supply ports 45, the horizontal portion 46*b* of each flow path 46 extends outside an area where the discharge circuit section 41 occupies in a horizontal surface, on one side of the longitudinal direction of the supply port 45, and in this part, it needs to have a configuration connecting to the vertical portion 46*a*. In this case, the vertical portions 46*a* are preferably arranged alternately on opposite sides in the order in which the supply ports 45 are arranged, as shown in FIG. 8C.

Figure 8A:
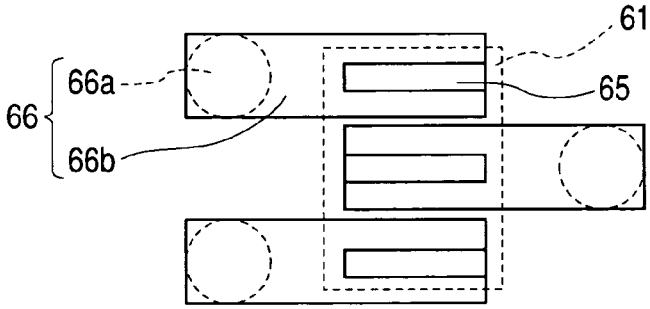
FIGS. 8A and 8B are plan sectional views of the ink jet recording head cartridge having a configuration to be contrasted with FIG. 8C.
Figure 8B:
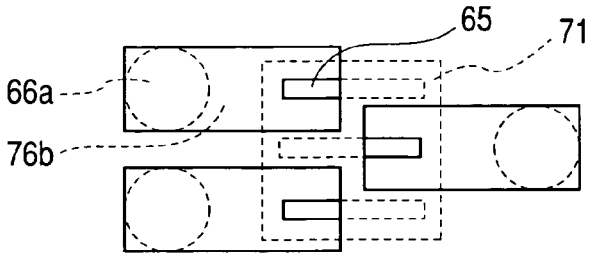
Figure 8C:
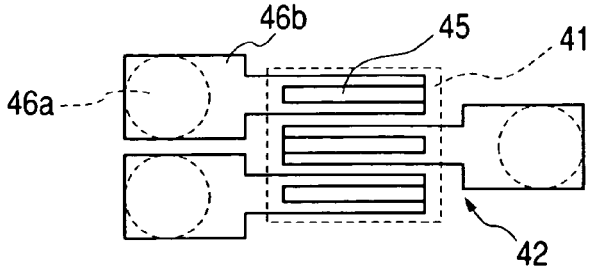
FIG. 8C is a plan sectional view of the ink jet recording head cartridge having a plurality of ink supply systems in one embodiment of the present invention

FIGS. 8A and 8B show configurations to be contrasted with the configuration according to the present invention shown in FIG. 8C. In the configuration shown in FIG. 8A, as parts of horizontal portions 66*b* of a plurality of flow paths 66, which extend above supply ports 65 of a discharge circuit section 61, overlap each other, it is necessary to have a relatively large space between the plurality of supply ports 65. Therefore, the configuration shown in FIG. 8A has a disadvantage that the size of the discharge circuit section 61 can not be reduced. In the configuration shown in FIG. 8B, parts of horizontal portions 76*b*, which extend over a discharge circuit section 71, are shortened so that the adjacent horizontal portions 76*b* of the plurality of flow paths 66 do not overlap each other. This makes it possible to reduce the space between the supply ports 65, but the supply ports 65 are connected to the flow paths 66 in only part of the width of the discharge circuit section 71, which means that openings of the supply ports 65 to the flow paths 66 become small. Therefore, the configuration shown in FIG. 8B has a disadvantage that the bubble produced in the ink in the discharge circuit section 71 is difficult to lead to the flow paths 66.

On the other hand, in the configuration according to the present invention shown in FIG. 8C, parts of the horizontal portions 46*b* of the flow path 46, which are adjacent on the discharge circuit section 41, have a relatively narrow width owing to throttle portions 42, so that the space between the supply ports 45 can be reduced with ease. Therefore, according to the configuration of the present invention, the size of the discharge circuit section 41 can be reduced, and the more compact configuration of the ink jet recording head cartridge is possible. In this case, the proportion of the manufacturing cost of a heating circuit section is high in the total manufacturing costs of the ink jet cartridge, so that the manufacturing cost can be effectively kept low by reducing the size of the heating circuit section.

What is claimed is:

1. An ink jet recording head cartridge comprising:

a liquid container for retaining a liquid;

a discharge circuit section which comprises a supply port for receiving the liquid in the liquid container, a nozzle in communication with the supply port, and a discharge energy generating element, provided in the nozzle, for discharging the liquid; and a flow path for leading the liquid from the liquid container to the discharge circuit section;

wherein the flow path comprises a vertical portion extending from a portion connecting to the ink container, and a horizontal portion connecting to a lower end of the vertical portion and connecting to the supply port of the discharge circuit section;

a throttle portion whose width becomes narrower in a supply direction of the liquid is formed in a portion, which connects to the vertical portion, of the horizontal portion of the flow path; and a groove shaped flow path whose width is narrower than the total width of the flow path is contiguously formed on an inner wall of the flow path from the portion connecting to the liquid container to a portion connecting to the discharge circuit section.

2. The ink jet recording head cartridge according to claim 1, wherein the throttle portion comprises a set of walls vertical to a surface in which the supply port of the discharge circuit section is provided, and the set of walls is provided so that a distance therebetween becomes gradually smaller from the liquid container toward the discharge circuit section.

3. The ink jet recording head cartridge according to claim 1, wherein an inclined portion, which becomes gradually higher in a direction departing from the discharge circuit section, is provided at a ceiling portion of the horizontal portion of the flow path.

4. The ink jet recording head cartridge according to claim 1, wherein the groove shaped flow path extends through the ceiling portion of the horizontal portion of the flow path.

5. The ink jet recording head cartridge according to claim 1, wherein the groove shaped flow path extends through a bottom surface of the horizontal portion of the flow path.

6. The ink jet recording head cartridge according to claim 1, wherein the supply port extends over the total width of the discharge circuit section, and a whole area of the supply port is in communication with the flow path.

* * * * *